United States Patent [19]

Koike et al.

[11] Patent Number: 4,923,845

[45] Date of Patent: May 8, 1990

[54] HEAT-SENSITIVE RECORDING MATERIAL

[75] Inventors: Naomasa Koike, Tokyo; Fumio Okumura, Kunitachi, both of Japan

[73] Assignee: 501 Mitsubishi Paper Mills, Ltd., Tokyo, Japan

[21] Appl. No.: 261,615

[22] Filed: Oct. 24, 1988

[30] Foreign Application Priority Data

Oct. 31, 1987 [JP] Japan ..... 62-276463
Dec. 14, 1987 [JP] Japan ..... 62-317178

[51] Int. Cl.[5] ..... B41M 5/18

[52] U.S. Cl. ..... 503/226; 427/152; 428/913; 503/200; 503/207; 503/214

[58] Field of Search ..... 427/152, 150, 151; 428/524, 530, 913, 914; 503/200, 207, 214, 226

[56] References Cited

FOREIGN PATENT DOCUMENTS

| | | | |
|---|---|---|---|
| 31793 | 2/1983 | Japan | 503/207 |
| 31794 | 2/1983 | Japan | 503/207 |
| 2117787 | 5/1987 | Japan | 503/207 |

*Primary Examiner*—Pamela R. Schwartz
*Attorney, Agent, or Firm*—Cushman, Darby & Cushman

[57] ABSTRACT

A heat-sensitive recording material is disclosed. The material comprises a support and a heat-sensitive recording layer, between which is provided an undercoat layer which comprises a first layer comprising urea-formaldehyde resin and a second layer comprising a pigment provided on the first layer. The first layer may additionally contain a pigment.

12 Claims, No Drawings

HEAT-SENSITIVE RECORDING MATERIAL

BACKGROUND OF THE INVENTION

1. Field of the Invention and Related Art Statement

This invention relates to a heat-sensitive recording material which is superior in thermal response and forms little detritus which often sticks to a thermal head.

2. Discussion of Related Art

Generally, heat-sensitive recording materials comprise a support and, provided thereon, a heat-sensitive recording layer mainly composed of an electron donating normally colorless or a pale colored dye precursor and an electron accepting color developer which react with each other instantly upon being heated by a thermal head, a thermal pen or a laser beam to obtain recorded images. These are disclosed in Japanese Patent Kokoku Nos. 43-4160 and 45-14039. These heat-sensitive recording materials have the following advantages: Record can be obtained by relatively simple apparatus; maintenance is easy; and no noise appears. Thus, these recording materials are used in a wide variety of fields such as instrumentation, facsimiles, printers, terminals of computers, labels and tickets vending machines. Especially, heat-sensitive recording systems have been greatly demanded in the field of facsimile. Thus, there has been developed a speeding-up of recording for reduction of transmission cost and lowering of energy for attaining reduction of costs by miniaturization of facsimiles, and for the speeding-up and lowering of energy, enhancement of sensitivity of heat-sensitive recording materials has been demanded. On the other hand, hitherto, dot density of thermal heads has generally been 8 dots/mm, but now there is the demand, more than before, to print small letters in high image quality by increasing the dot density to 16 dots/mm, for example, and decreasing the dot area, to make gradational printing according to dither method and to obtain images of good print quality which are a faithful reproduction of the dot patterns of a head.

In order to meet these demands, when the recording sheet is subjected to strong supercalendering treatment to improve contact between the sheet and thermal head, so-called fogging occurs due to a reduction of the whiteness thereof.

Japanese Patent Kokai No. 56-27394 has proposed to provide an under coat layer between a heat-sensitive layer and a base paper according to which images of high density can be obtained with a low printing energy without strong supercalendering and thus enhancement of sensitivity has become possible. Application of this undercoat layer is effective for smoothing the surface of a heat-sensitive layer by filling-up irregularities on the surface of support to smooth the surface of the support.

In this way, enhancement of sensitivity has been made by application of an undercoat layer. However, application of an undercoat layer alone which aims at only smoothening of the surface cannot satisfy the recent demands for further enhancement of sensitivity and for improvement of the reproducibility of dot patterns.

OBJECT AND SUMMARY OF THE INVENTION

The object of this invention is to provide a heat-sensitive sheet superior in thermal response for meeting the demands for further enhancement of sensitivity and improvement in reproducibility of dot patterns which have not been solved by conventional techniques.

This invention relates to a heat-sensitive recording material which comprises a support and a heat-sensitive layer between which is provided an undercoat layer of two-layer structure which comprises a first layer comprising a powdered urea-formaldehyde resin and, if necessary, other pigment and, provided thereon, a second layer of a pigment.

DETAILED DESCRIPTION OF PREFERRED EMBODIMENT

It is considered that an urea-formaldehyde resin power coated as a first layer has the effect to make the surface smoother by filling-in irregularities on the surface of the support layer such as an undercoat layer of pigment and also exhibits a heat insulating effect due to both the small heat conductivity of urea-formaldehyde resin per se and the air retention characteristic of porous urea-formaldehyde resin powder and thus escape of heat energy from thermal head to the outside of the system can be prevented and heat energy can more effectively act on the heat-sensitive layer.

However, when a heat-sensitive layer is provided directly on the urea-formaldehyde resin powder layer, a color former component, melted by heat energy from thermal head, is absorbed into the porous urea-formaldehyde resin layer to diffuse the color image, resulting in reduction of image density. The pigment layer coated as a second layer on the urea-formaldehyde resin powder layer is considered to have an effect of preventing the above defect and also an effect to make smoother the surface which has already been smoothed by coating the first layer.

The thus obtained heat-sensitive recording material with the first layer composed of urea-formaldehyde resin alone can accomplish improvement of printability by maximum utilization of its heat insulating effect. However, due to the inferior adhesion resulting from porosity of urea-formaldehyde resin, there is the possibility of causing the problem that peeling off of the coat occurs, for example, when letters are written thereon by pencil or in some cases, the powders fall off during the running of machines such as facsimiles and accumulate in those machines. Therefore, heat-sensitive recording materials further improved in adhesion are required depending on uses and functions. Although this problem can be solved by increasing the amount of adhesive to increase adhesion strength, there is the possibility of causing a reduction of the heat insulating characteristic of the urea-formaldehyde resin when the amount of adhesive is increased too much. As a result of research in an attempt to solve this problem, it has been found that the problem can be solved by forming the first layer comprising urea-formaldehyde resin and 10% by weight or more of other pigment in combination. However, with increase in the amount of the other pigment, heat insulating characteristic of the urea-formaldehyde resin is also decreased and so the addition amount of the other pigment is preferably 10–50% by weight, although it depends on effects required.

The urea-formaldehyde resin used for the first layer is not critical and may be suitably chosen.

The pigments which may be used in combination with urea-formaldehyde resin in the first layer include organic pigments other than urea-formaldehyde resin such as fine particles of polyethylene, polystyrene and ethylene-vinyl acetate and inorganic pigments normally used for coated papers. As examples thereof, mention may be made of calcium carbonate, kaolin, calcined kaolin, zinc oxide, titanium oxide, aluminum hydroxide, zinc hydroxide, barium sulfate, and silicon oxide. These may be used alone or in combination of two or more together with urea-formaldehyde resin.

As the pigment used for the second layer, mention may be made of, for example, inorganic pigments such as calcium carbonate, kaolin, calcined kaolin, zinc oxide, titanium oxide, aluminum hydroxide, zinc hydroxide, barium sulfate and silicon oxide. These may be used alone or in combination of two or more. If necessary, fine powder organic pigments such as, for example, urea-formaldehyde resin, polyethylene, polystyrene and ethylene-vinyl acetate may be used alone or in combination of two or more or together with the inorganic pigments. Among them, pigments having an oil absorption of 70 ml/100 g or more, especially calcined kaolin and silicon oxide are preferred because in addition to the aforementioned effects, they have the effect to adsorb the heated and melted heat-sensitive layer component without causing a diffusion effect as urea-formaldehyde resin powder does, resulting in reduction of adhering of deltritus to thermal head.

Coating of the first layer at a coverage of at least 1 $g/m^2$ can provide the effect, but preferred coating amount is 3–15 $g/m^2$ because coating of too large an amount results in problems which are not with the heat-sensitive characteristics, but rather in the characteristics as a paper, for example, reduction of stiffness caused by using a thin base paper to compensate for increase of thickness of the layer. The coating amount of the second layer is most preferably 1–10 $g/m^2$ for serving as the second layer without damaging the effect of the first layer. If the coating amount of the second layer is too much, thermal conductivity is deteriorated and sometimes heat retaining and insulating effects of the first layer cannot be fully utilized.

Desired characteristics are obtained by providing a heat-sensitive layer on this undercoat layer.

The dye precursors used in this invention are not critical and any of those which are generally used for pressure-sensitive recording sheets and heat-sensitive recording sheets may be used. Typical examples thereof are as follow:

(1) Triarylmethane compounds:

3,3-bis(p-dimethylaminophenyl)-6-dimethylaminophthalide (Crystal Violet Lactone), 3,3-bis(p-dimethylaminophenyl) phthalide, 3-(p-dimethylaminophenyl)-3-(1,2-dimethylindol-3-yl) phthalide, 3-(p-dimethylaminophenyl)-3-(2-methylindol-3-yl) phthalide, 3-(p-dimethylaminophenyl)-3-(2-phenylindol-3-yl) phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazole-3-yl)-5-dimethylaminophthalide, 3,3-bis(2-phenylindol-3-yl)-5-dimethylaminophthalide and 3-p-dimethylaminophenyl-3-(1-methylpyrrole-2-yl)-6-dimethylaminophthalide.

(2) Diphenylmethane compounds:

4,4'-bis-dimethylaminophenylbenzhydrylbenzyl ether, N-halophenylleucoauramine, and N-2,4,5-trichlorophenylleucoauramine.

(3) Xanthene compounds:

Rhodamine B anilinolactam, Rhodamine B-p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino) fluoran, 3-diethylamino-6-methyl-7-anilinofluoran, 3-(N-ethyl-N-tolyl) amino-6-methyl-7-anilinofluoran, 3-piperidino-6-methyl-7-anilinofluoran, 3-(N-ethyl-N-tolyl) amino-6-methyl-7-phenethylfluoran, 3-diethylamino-7-(4-nitroanilinofluoran), 3-dibutylamino-6-methyl-7-anilinofluoran, 3-(N-methyl-N-propyl) amino-6-methyl-7-anilinofluoran, 3-(N-ethyl-N-isoamyl) amino-6-methyl-7-anilinofluoran, 3-(N-methyl-N-cyclohexyl) amino-6-methyl-7-anilinofluoran and 3-(N-ethyl-N-tetrahydrofuryl) amino-6-methyl-7-anilinofluoran.

(4) Thiazine compounds:

Benzoyl Leucomethylene Blue and p-nitrobenzoyl Leucomethylene Blue.

(5) Spiro compounds:

3-Methylspirodinaphthopyran, 3-ethylspirodinaphthopyran, 3,3'-dichlorospironaphthopyran, 3-benzylspirodinaphthopyran, 3-methylnaphtho-(3-methoxybenzo) spiropyran and 3-propylspirobenzopyran.

These may be used alone or in combination of two or more.

As the color developers used in this invention, there may be used electron accepting substances generally used for heat-sensitive sheet and preferred are phenol derivatives, aromatic carboxylic acid derivatives or metallic compounds thereof and N,N'-diarylthiourea derivatives. Among them especially preferred are phenol derivatives and as examples thereof, mention may be made of 1,1-bis(p-hydroxyphenyl)propane, 2,2-bis(p-hydroxyphenyl) propane, 2,2-bis(p-hydroxyphenyl) butane, 2,2-bis(p-hydroxyphenyl) hexane, bisphenolsulfone, bis(3-allyl-4-hydroxyphenyl)sulfone, 4-hydroxy-4'-isopropyloxydiphenylsulfone, 3,4-dihydroxy-4'-methyldiphenylsulfone, diphenol ether, benzyl p-hydroxybenzoate, propyl p-hydroxybenzoate and butyl p-hydroxybenzoate.

In addition, if necessary, pigments, sensitizers, antioxidants, sticking inhibitors and the like are added to the heat sensitive layer.

Various binders customarily used can be used for dye precursor, color developer, other additives, urea-formaldehyde resin-pigment mixture used in undercoat layer and pigment in the second layer. As examples thereof, mention may be made of water-soluble binders such as starches, hydroxyethylcellulose, methylcellulose, carboxymethylcellulose, gelatin, casein, polyvinyl alcohol, modified polyvinyl alcohol, sodium polyacrylate, acrylic acid amide/acrylate ester copolymer, acrylic acid amide/acrylate ester/methacrylic acid terpolymer, alkali salts of styrene/maleic anhydride copolymer, and alkali salts of ethylene/maleic anhydride copolymer and latices such as polyvinyl acetate, polyurethane, polyacrylate esters, styrene/butadiene copolymer, acrylonitrile/butadiene copolymer, methyl acrylate/butadiene copolymer, and ethylene/vinyl acetate copolymer.

As the support, paper is mainly used, but non-woven fabric, plastic film, synthetic paper, metal foil and composite sheet comprising combination of them may also be used.

The following examples further illustrate the invention, wherein part and % are all by weight and coating amount is dry amount unless otherwise noted.

EXAMPLE 1

(1) Preparation of suspension A (coating composition for the first layer)

A mixture comprising the following components was stirred to prepare a coating composition for the first layer.

| | |
|---|---|
| "Uniseal" (urea-formaldehyde resin supplied by Ciba-Geigy Corp.) | 20 parts |
| Styrene-butadiene copolymer latex (50% aqueous dispersion) | 6 parts |
| Water | 80 parts |

(2) Preparation of suspension B (coating composition for the second layer)

A mixture comprising the following components was stirred to prepare a coating composition for the second layer.

| | |
|---|---|
| "Anisilex" (calcined kaolin supplied by Engelhard Industries) | 100 parts |
| Styrene-butadiene copolymer latex (50% aqueous dispersion) | 24 parts |
| "MS 4600" (phosphoric acid esterified starch supplied by Nippon Shokuhin Co.) (10% aqueous solution) | 60 parts |
| Water | 52 parts |

(3) Preparation of heat-sensitive coating composition

A mixture comprising the following components was milled and dispersed to an average particle size of about 1 μm in a ball mill to prepare suspension C and suspension D.

[Suspension C]

| | |
|---|---|
| 3-(N-methyl-N-cyclohexyl) amino-6-methyl-7-anilinofluoran) | 40 parts |
| 10% aqueous polyvinyl alcohol solution | 20 parts |
| water | 40 parts |

[Suspension D]

| | |
|---|---|
| Bisphenol A | 50 parts |
| Benzyloxynaphthalene | 50 parts |
| 10% aqueous polyvinyl alcohol solution | 50 parts |
| Water | 100 parts |

Then, a heat-sensitive coating composition was prepared by the following formulation using the resulting suspension C and suspension D.

| | |
|---|---|
| Suspension C | 50 parts |
| Suspension D | 250 parts |
| Zinc stearate (40% aqueous dispersion) | 25 parts |
| 10% aqueous polyvinyl alcohol solution | 216 parts |
| Calcium carbonate | 50 parts |
| Water | 417 parts |

Each of the thus prepared coating compositions was coated on a base paper of 40 g/m$^2$ in basis weight at the following coating amount by Meyer bar to produce a heat-sensitive recording material.

| | |
|---|---|
| The first layer | 3 g/m$^2$ |

-continued

| | |
|---|---|
| The second layer | 3 g/m$^2$ |
| Heat-sensitive layer | 5.5 g/m$^2$ |

EXAMPLES 2–4

Heat-sensitive recording materials were prepared in the same manner as in Example 1 except that coating amount of the first layer was 7 g/m$^2$, 10 g/m$^2$ and 14 g/m$^2$ in place of 3 g/m$^2$.

EXAMPLES 5–7

Heat-sensitive recording materials were prepared in the same manner as in Example 1 except that coating amount of the first layer was 7 g/m$^2$ in place of 3 g/m$^2$ and coating amount of the second layer provided on the first layer was 1 g/m$^2$, 6 g/m$^2$ and 9 g/m$^2$.

EXAMPLE 8

Suspension B (coating composition for the second layer) was prepared in the same manner as in Example 1 except that 100 parts of "Ultrawhite-90" (coating kaolin supplied by Engelhard Industries) was used in place of 100 parts of "Ansilex". The resulting suspension B and suspension A and heat-sensitive coating composition prepared in Example 1 were coated on a base paper of 40 g/m$^2$ in basis weight by Meyer bar in the following coating amounts at drying to obtain a heat-sensitive recording material.

| | |
|---|---|
| The first layer | 7 g/m$^2$ |
| The second layer | 3 g/m$^2$ |
| Heat-sensitive layer | 5.5 g/m$^2$ |

COMPARATIVE EXAMPLE 1

A comparative heat-sensitive recording material was prepared in the same manner as in Example 1 except that the coating composition for the second layer was directly coated on the base paper at a coating amount of 8 g/m$^2$ without coating the coating composition for the first layer and then the heat-sensitive coating composition was coated thereon at a coating amount of 5.5 g/m$^2$.

COMPARATIVE EXAMPLE 2

A comparative heat-sensitive recording material was prepared in the same manner as in Example 1 except that the coating composition for the second layer was directly coated on the base paper at a coating amount of 7 g/m$^2$ without coating the first layer and the coating composition for the second layer was again coated thereon at a coating amount of 3 g/m$^2$, thereby to form an undercoat layer and then the heat-sensitive coating composition was coated thereon at a coating amount of 5.5 g/m$^2$.

COMPARATIVE EXAMPLE 3

A comparative heat-sensitive recording material was prepared in the same manner as in Example 1 except that the coating composition for the first layer was coated at a coating amount of 7 g/m$^2$ and then the heat-sensitive coating composition was coated directly thereon without coating the second layer.

COMPARATIVE EXAMPLE 4

In the same manner as in Example 1 each coating composition was coated on a base at the following coating amount.

| | |
|---|---|
| The first layer | 7 g/m$^2$ |
| The second layer | 12 g/m$^2$ |
| The heat-sensitive layer | 5.5 g/m$^2$ |

The heat-sensitive recording materials prepared above were treated by a supercalender to give a Bekk smoothness of 400–500 seconds. The recording material was tested for recording density, printability and degree of sticking of detritus by means of G III FAX tester (TH-PMD manufactured by Ohkura Denki Co.). A thermal head with a dot density of 8 dots/mm and head resistance of 185 Ω was used and recording was carried out with a head voltage of 11 V and application time of 0.5 ms and 0.8 ms. The recording density was measured by Macbeth RD-514 type reflective densitometer. The results are shown in Table 1.

TABLE 1

| | Sensitivity | | | |
|---|---|---|---|---|
| | 0.5 ms | 0.8 ms | Printability | Detritus |
| Example 1 | 1.03 | 1.32 | o~Δ | o |
| Example 2 | 1.07 | 1.31 | o | o |
| Example 3 | 1.08 | 1.32 | o | o |
| Example 4 | 1.07 | 1.32 | o | o |
| Example 5 | 1.08 | 1.33 | o | o~Δ |
| Example 6 | 1.05 | 1.32 | o | o |
| Example 7 | 1.03 | 1.33 | o | o |
| Example 8 | 1.06 | 1.32 | o | o~Δ |
| Comparative Example 1 | 0.87 | 1.33 | x | o |
| Comparative Example 2 | 0.90 | 1.32 | x | o |
| Comparative Example 3 | 0.55 | 1.11 | x | o~Δ |
| Comparative Example 4 | 0.95 | 1.33 | Δ | o |

EXAMPLE 9

(1) Preparation of suspension A (coating composition for the first layer)

A mixture comprising the following components was stirred to prepare a coating composition for the first layer.

| | |
|---|---|
| "Uniseal" (urea-formaldehyde resin supplied by Ciba-Geigy Corp.) | 15 parts |
| "Ansilex" (calcined kaolin supplied by Engelhard Industries) | 5 parts |
| Styrene-butadiene copolymer latex (50% aqueous dispersion) | 6 parts |
| Water | 80 parts |

(2) Preparation of suspension B (coating composition for the second layer)

A mixture comprising the following components was stirred to prepare a coating composition for the second layer.

| | |
|---|---|
| "Ansilex" | 100 parts |
| Styrene-butadiene copolymer latex (50% aqueous dispersion) | 24 parts |
| "MS 4600" (phosphoric acid esterified starch supplied by Nippon Shokuhin Co.) | 60 parts |

-continued

| | |
|---|---|
| (10% aqueous solution) | |
| Water | 52 parts |

(3) Preparation of heat-sensitive coating composition

A mixture comprising the following components was milled and dispersed to an average particle size of about 1 μm in a ball mill to prepare suspension C and suspension D.

[Suspension C]

| | |
|---|---|
| 3-(N-methyl-N-cyclohexyl) amino-6-methyl-7-anilinofluoran) | 40 parts |
| 10% aqueous polyvinyl alcohol solution | 20 parts |
| Water | 40 parts |

[Suspension D]

| | |
|---|---|
| Bisphenol A | 50 parts |
| Benzyloxynaphthalene | 50 parts |
| 10% aqueous polyvinyl alcohol solution | 50 parts |
| Water | 100 parts |

Then, a heat-sensitive coating composition was prepared by the following formulation using the resulting suspension C and suspension D.

| | |
|---|---|
| Suspension C | 50 parts |
| Suspension D | 250 parts |
| Zinc stearate (40% aqueous dispersion) | 25 parts |
| 10% aqueous polyvinyl alcohol solution | 216 parts |
| Calcium carbonate | 50 parts |
| Water | 417 parts |

Each of the thus prepared coating compositions was coated on a base paper of 40 g/m$^2$ in basis weight at the following coating amount by Meyer bar to produce a heat-sensitive recording material.

| | |
|---|---|
| The first layer | 3 g/m$^2$ |
| The second layer | 3 g/m$^2$ |
| Heat-sensitive layer | 5.5 g/m$^2$ |

EXAMPLES 10–12

Heat-sensitive recording materials were prepared in the same manner as in Example 9 except that coating amount of the first layer was 7 g/m$^2$, 10 g/m$^2$ and 14 g/m$^2$ in place of 3 g/m$^2$.

EXAMPLES 13–15

Heat-sensitive materials were prepared in the same manner as in Example 9 except that coating amount of the first layer was 7 g/m$^2$ in place of 3 g/m$^2$ and coating amount of the second layer provided on the first layer was 1 g/m$^2$, 6 g/m$^2$ and 9 g/m$^2$.

EXAMPLE 16

Suspension B (coating composition for the second layer) was prepared in the same manner as in Example 9 except that 100 parts of "Ultrawhite-90" (coating kaolin supplied by Engelhard Industries) was used in place of 100 parts of "Ansilex". The resulting suspension B and suspension A and heat-sensitive coating composition prepared in Example 9 were coated on a base paper of 40 g/m² in basis weight by Meyer bar in the following coating amounts at drying to obtain a heat-sensitive recording material.

| | |
|---|---|
| The first layer | 7 g/m² |
| The second layer | 3 g/m² |
| Heat-sensitive layer | 5.5 g/m² |

EXAMPLE 17

Suspension A (coating composition for the first layer) was prepared in the same manner as in Example 9 except that 12 parts of urea-formaldehyde resin and 8 parts of "Ansilex" were used in place of 15 parts of urea-formaldehyde resin and 5 parts of "Ansilex". The resulting suspension A and suspension B and heat-sensitive coating composition prepared in Example 9 were coated on a base paper of 40 g/m² in basis weight by Meyer bar in the following coating amounts at drying to obtain a heat-sensitive recording material.

| | |
|---|---|
| The first layer | 7 g/m² |
| The second layer | 3 g/m² |
| Heat-sensitive layer | 5.5 g/m² |

EXAMPLE 18

Heat-sensitive material was prepared in the same manner as in Example 17 except that suspension A was prepared using 8 parts of urea-formaldehyde resin and 12 parts of "Ansilex" in place of 12 parts of urea-formaldehyde resin and 8 parts of "Ansilex".

EXAMPLE 19

Heat-sensitive material was prepared in the same manner as in Example 9 except that 5 parts of "Ultra-white-90" was used in place of 5 parts of "Ansilex" in preparation of suspension A.

COMPARATIVE EXAMPLE 5

A comparative heat-sensitive recording material was prepared in the same manner as in Example 9 except that the coating composition for the second layer was directly coated on the base paper at a coating amount of 8 g/m² without coating the coating composition for the first layer and then the heat-sensitive coating composition was coated thereon at a coating amount of 5.5 g/m².

COMPARATIVE EXAMPLE 6

A comparative heat-sensitive recording material was prepared in the same manner as in Example 9 except that the coating composition for the second layer was directly coated on the base paper at a coating amount of 7 g/m² without coating the first layer and the coating composition for the second layer was again coated thereon at a coating amount of 3 g/m², thereby to form an undercoat layer and then the heat-sensitive coating composition was coated thereon at a coating amount of 5.5 g/m².

COMPARATIVE EXAMPLE 7

A comparative heat-sensitive recording material was prepared in the same manner as in Example 9 except that the coating composition for the first layer was coated at a coating amount of 7 g/m² and then the heat-sensitive coating composition was coated directly thereon without coating the second layer.

COMPARATIVE EXAMPLE 8

Comparative heat-sensitive material was prepared in the same manner as in Example 17 except that 20 parts of urea-formaldehyde resin was used in place of 12 parts of urea-formaldehyde resin and 8 parts of "Ansilex" (That is, "Ansilex" was not used in preparation of suspension A).

COMPARATIVE EXAMPLE 9

In the same manner as in Example 9 each coating composition was coated on a base paper at the following coating amount.

| | |
|---|---|
| The first layer | 7 g/m² |
| The second layer | 12 g/m² |
| The heat-sensitive layer | 5.5 g/m² |

The heat-sensitive recording materials prepared above were treated by a supercalender to give a Bekk smoothness of 400–500 seconds. The recording material was tested for recording density, printability and degree of sticking of detritus by means of G III FAX tester (TH-PMD manufactured by Ohkura Denki Co.). A thermal head with a dot density of 8 dots/mm and head resistance of 185 Ω was used and recording was carried out with a head voltage of 11 V and current application time of 0.5 ms and 0.8 ms. The recording density was measured by Macbeth RD-514 type reflective densitometer. Adhesion was evaluated by observing the degree of peeling of the coat when writing was carried out by pencil on the surface of the coat of the heat-sensitive recording material. The results are shown in Table 2.

TABLE 2

| | Sensitivity | | Print- | | Ad- |
|---|---|---|---|---|---|
| | 0.5 ms | 0.8 ms | ability | Detritus | hesion |
| Example 9 | 1.02 | 1.32 | o~Δ | o | o |
| Example 10 | 1.07 | 1.33 | o | o | o |
| Example 11 | 1.07 | 1.31 | o | o | o |
| Example 12 | 1.09 | 1.32 | o | o | o |
| Example 13 | 1.07 | 1.32 | o | o~Δ | o |
| Example 14 | 1.05 | 1.31 | o | o | o |
| Example 15 | 1 01 | 1.33 | o | o | o |
| Example 16 | 1.06 | 1.32 | o | o~Δ | o |
| Example 17 | 1.05 | 1.33 | o | o | o |
| Example 18 | 1.03 | 1.33 | o~Δ | o | o |
| Example 19 | 1.08 | 1.32 | o~Δ | o | o |
| Comparative Example 5 | 0.87 | 1.33 | x | o | o |
| Comparative Example 6 | 0.90 | 1.32 | x | o | o |
| Comparative Example 7 | 0.55 | 1.11 | x | o~Δ | o |
| Comparative Example 8 | 1.07 | 1.31 | o | o | x |
| Comparative Example 9 | 0.95 | 1.33 | Δ | o | o |

o: Good
o~Δ: Fairly good
Δ: The material can barely be used.
x: The material cannot be used.
(These criteria are also applicable to the results shown in Table 1).

As is clear from the results in Tables 1 and 2, in the heat-sensitive recording material of this invention which includes an undercoat layer comprising a first layer comprising urea-formaldehyde resin or this resin and other pigment in combination and a second layer comprising a pigment and a heat-sensitive layer coated on said undercoat layer, neither peeling of coat nor failing off of powder occurs and even if they occur, there are substantially no problems, thermal response is improved as compared with conventional heat-sensitive recording materials and improvement in sensitivity and reproducibility of dot patterns can be attained without increase in detritus which stick to the head.

What is claimed is:

1. A heat-sensitive recording material which comprises a support and, provided thereon in succession, an undercoat layer and a heat-sensitive layer comprising a dye precursor and a color developer which, upon being heated, reacts with said dye precursor to develop color, said undercoat layer comprising a first layer comprising urea-formaldehyde resin and a second layer comprising a pigment and a binder provided on the first layer.

2. A heat-sensitive recording material according to claim 1 wherein the first layer of the undercoat layer additionally contains a pigment.

3. A heat-sensitive recording material according to claim 2 wherein said pigment in the first layer of the undercoat layer is an inorganic pigment.

4. A heat-sensitive recording material according to claim 2 wherein said pigment in the first layer of the undercoat layer is contained in an amount of at least 10% by weight of the urea-formaldehyde resin.

5. A heat-sensitive recording material according to claim 2 wherein the pigment of the second layer of the undercoat layer has an oil absorption of at least 70 ml/100 g.

6. A heat-sensitive recording material according to claim 5 wherein the pigment having an oil absorption of at least 70 ml/100 g is a calcined kaolin or silicon oxide.

7. A heat-sensitive recording material according to claim 1 wherein the pigment of the second layer of the undercoat layer has an oil absorption of at least 70 ml/100 g.

8. A heat-sensitive recording material according to claim 7 wherein the pigment having an oil absorption of at least 70 ml/100 g is a calcined kaolin or silicon oxide.

9. A heat-sensitive recording material according to claim 1, wherein the binder is water-soluble.

10. A heat-sensitive recording material according to claim 9, wherein the water-soluble binder is a starch, hydroxyethylcellulose, methylcellulose, carboxymethylcellulose, gelatin, casein, polyvinyl alcohol, sodium polyacrylate, acrylic acid amide/acrylate ester copolymer, acrylic acid amide/acrylate ester/methacrylic acid terpolymer, an alkali salt of styrene/maleic anhydride copolymer or an alkali salt of ethylene/-maleic anhydride copolymer.

11. A heat-sensitive recording material according to claim 1, wherein the binder is applied at a latex of polyvinyl acetate, polyurethane, a polyacrylate ester, styrene/butadiene copolymer, acrylonitrile/butadiene copolymer, methyl acrylate/butadiene copolymer or ethylene/vinyl acetate copolymer.

12. A heat-sensitive recording material according to claim 1, wherein the binder is applied at a combination of styrene/butadiene copolymer latex and phosphoric acid esterified starch.

* * * * *